US005969693A

United States Patent [19]

Legg

[11] Patent Number: 5,969,693

[45] Date of Patent: Oct. 19, 1999

[54] MULTI-USER ANTENNA TELECOMMUNICATION TOWER

[75] Inventor: Dale R Legg, Skillman, N.J.

[73] Assignee: Edwards and Keley Wireless, L.L.C., Morristown, N.J.

[21] Appl. No.: 08/967,181

[22] Filed: Nov. 10, 1997

[51] Int. Cl.[6] ..... H01Q 1/12

[52] U.S. Cl. ..... 343/890; 343/872; 52/111

[58] Field of Search ..... 343/890, 872, 343/891, 878, 879; 52/111, 121, 114, 300, 465; H01Q 1/12

[56] References Cited

U.S. PATENT DOCUMENTS 5,162,807 11/1992 Ursenbach et al. ..... 343/890
5,200,759 4/1993 Mcginnis ..... 343/890
5,532,704 7/1996 Ruelle ..... 343/703
5,629,713 5/1997 Mailandt et al. ..... 343/808

*Primary Examiner*—Hoanganh Le
*Attorney, Agent, or Firm*—Robert I. Pearlman

[57] ABSTRACT

An enclosed multi-user telecommunications tower covering multiple antennas at various heights with communication passages allowing an operator to move internally between modules containing antennas. Individual adjustment and orientation of the antennas for each provider (or their replacement) is thus readily possible within the tower. The tower preferably comprises lower support modules of reinforced concrete and a steel tower for supporting the antenna systems. The latter is covered with a RF transparent skin covering of a fiber reinforced plastic. The communication means takes the form of an annular space between the steel tower support and the RF transparent skin covering wherein the multiple antennas are supported.

13 Claims, 4 Drawing Sheets

MULTI-USER ANTENNA TELECOMMUNICATION TOWER

BACKGROUND OF THE INVENTION

The present invention relates to an improved tower for telecommunication signals, such as used for microwave, electromagnetic, light wave, television, etc.

Prior art telecommunication towers have generally been of an open grid structure with antennas mounted in fixed position at the top of the support. Such open structures have many disadvantages. They are difficult to maintain. They require cables to prevent excessive swaying due to wind and are open to adverse weather conditions. They are additionally susceptible to vandalism, especially the cutting of the cables securing the tower in place.

Such traditional lattice towers are generally considered to be unattractive and may devalue surrounding property as well as presenting a hazard to birds flying into the cable supports.

Lattice towers or monopoles present a particular problem when designing a multi-provider facility at one location. In such a system each antenna must be tailored in its orientation and direction to the requirements of each user. Due to the different orientations of the different providers systems, ie different azimuths (horizontal angular distances from a fixed reference direction), this typically requires the frames supporting the antennas to be turned in different directions on the tower to be set to the proper azimuths.

As time passes the system becomes over crowded. The antennas must be adjusted or replaced to accommodate new cell sites. This is a difficult task in such systems, often requiring cranes or similar units to reach the antenna sites and to permit the necessary modifications. In addition to the physical problems, change of equipment and antennas on the tower requires reanalysis of loads versus the original design specification in order to comply with building codes.

There has been some movement away from such lattice towers for use as a telecommunication facility. Substantially totally enclosed towers with architecturally pleasing exteriors have recently come into use. The outside appearance is that of a building, church tower or the like rather than that of a telecommunications tower. However, such units do not offer flexibility of rearranging antennas, ready access thereto, as well as the ability to handle multi-users with different orientations.

The basic concept of forming a communications tower out of prefabricated modular units is shown in U.S. Pat. No. 3,768,016 to Townsend et al. (1973). It is noted that in the Townsend et al. system their antennas A are mounted outside of the tower and thus are exposed to the elements. Access to the antennas requires descending from the tower roof to these outside locations—a rather dangerous operation.

The present invention is directed to overcoming the disadvantages of the preceding systems and to providing a particularly desirable multi-user antenna telecommunications tower.

BRIEF DESCRIPTION OF THE INVENTION

The invention comprises a fully enclosed architecturally attractive system wherein multi-user antennas are positioned at different elevations and means are provided for an operator to move internally between antenna sites to make the necessary antenna adjustments. Normally the present system comprises prefabricated support modules, such as made of pre-stressed concrete, and internal structural tower modules of steel with an exterior cover of a suitable RF transparent material such as fiberglass or ABS plastic. The modular design defines an annular space between the structural tower and the covering of the antenna, ie the FRP (fiber reinforced plastic) exterior RF (radio frequency) transparent covering. This annular space is connected by a ladder, stairs or the like and sufficient for easy movement by an operator between antenna modules to permit adjustments and/or replacements to the antennas. This annular interior space allows the workers to safely move within the tower to any module-antenna configuration desired. The operator is able to adjust the orientation/horizontal spacing of the antennas to meet any provider's particular requirements. The horizontal, vertical, azimuth and down tilt can all be easily adjusted for the same or a different provider. Due to the flexibility the tower can be sited without regard to the orientation requirements of the antennas. The antennas are completely protected from the wind and other elements and the tower constructed to meet any architectural criteria desired. Since the exterior of the tower and interior structure remains unchanged, the tower never needs engineering reanalysis for new loadings.

Other features and the advantages of the present invention will be apparent from the following description when read with reference to the accompanying drawings.

DETAILED DESCRIPTION OF THE PRESENT INVENTION

Figure 1:
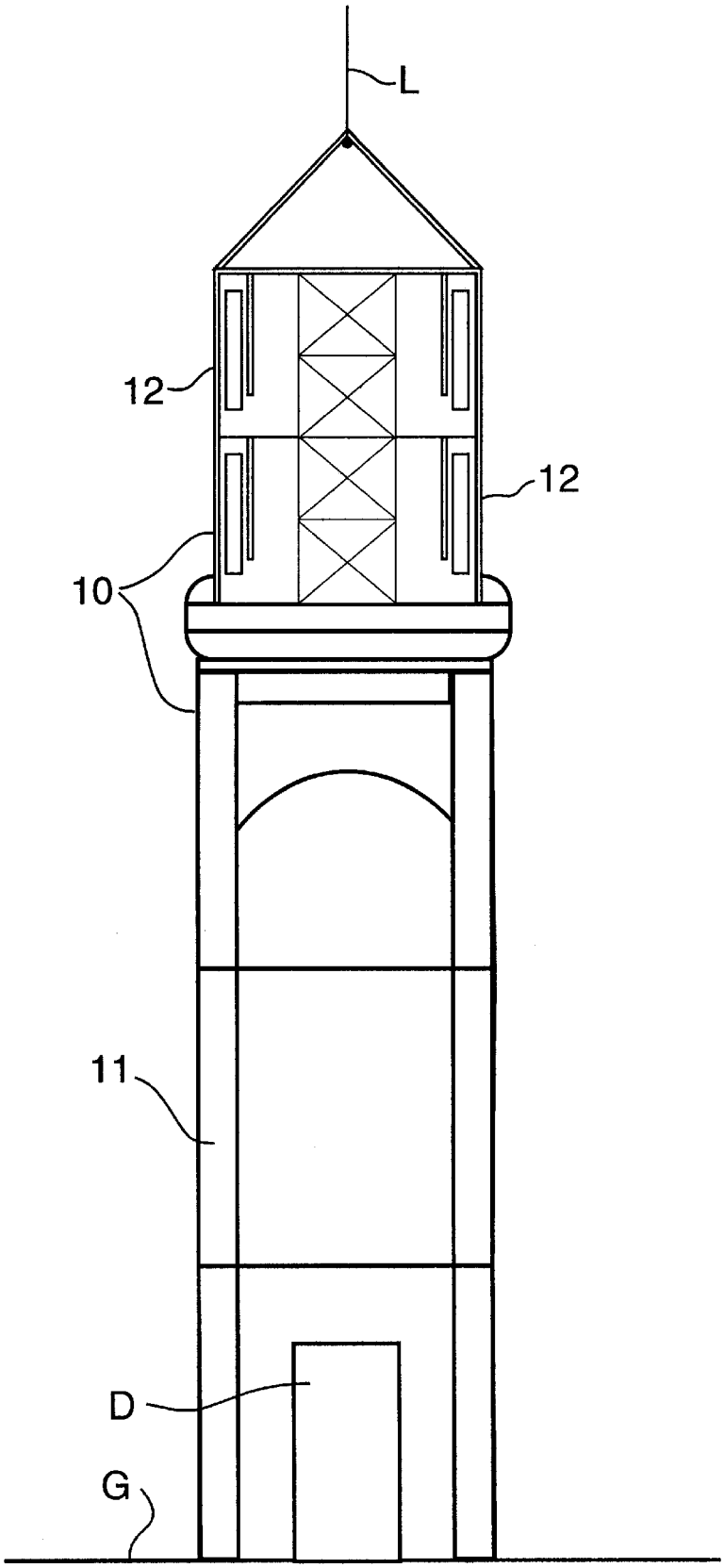
FIG. 1 is a view in elevation of the enclosed multi-user telecommunications tower of the present invention.
Figure 2:
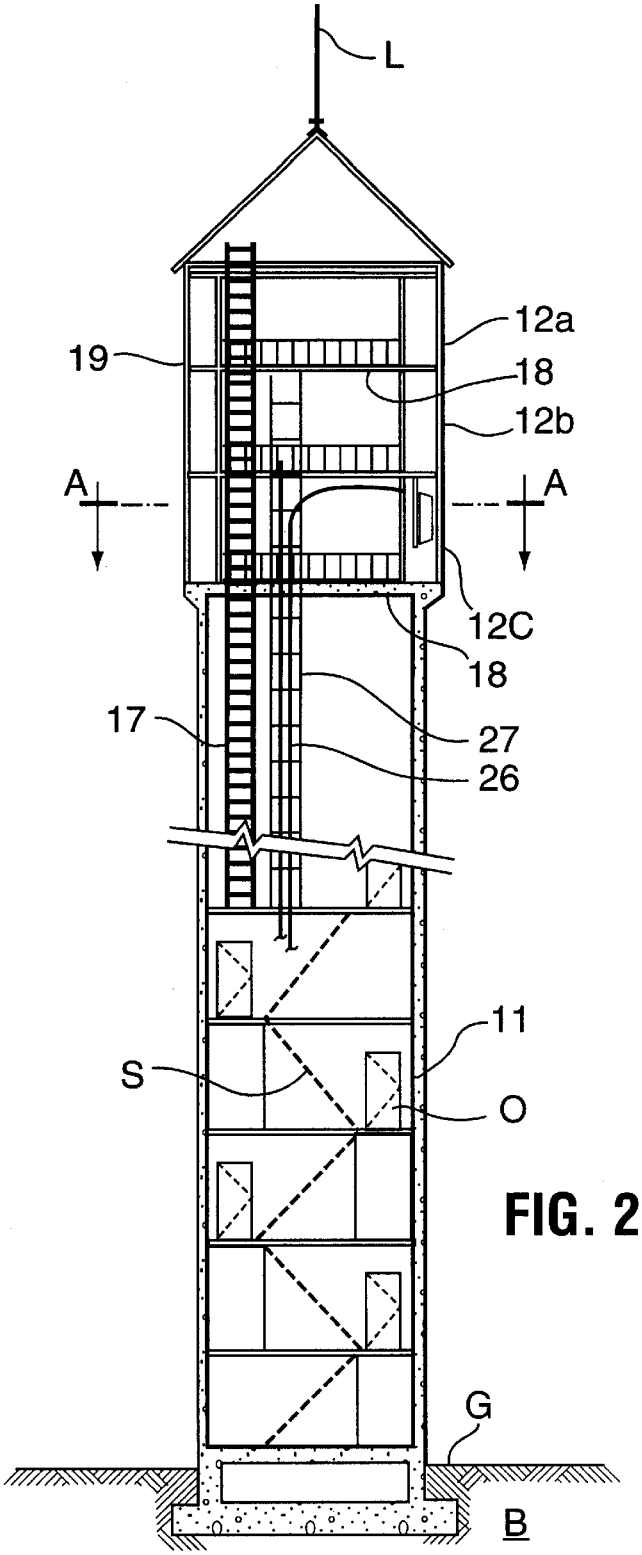
FIG. 2 is an enlarged sectional view in elevation, with positions broken away, of the tower shown in FIG. 1.

In the drawings, the same reference numbers are used to identify like parts. Tower 10 is generally illustrated in FIG. 1 in the form of an enclosed tower system comprising basically a concrete support base 11 and upper modules 12 containing multiple antennas. The overall unit can be given a pleasing architectural appearance in the form of a bell tower or the like not associated with telecommunications towers. It is supported at ground level G by a suitable base support B better illustrated in FIG. 2. Normally the tower will have a lightening rod L at its top portion, as well as an access door D at its bottom.

The base of the tower consists of a foundation and stem that fits the architecture of the site. Concrete base support 11 provides both the enclosure walls and the structural support for the tower. The base may contain only the essential equipment for the telecommunications tower, such as vertical access, vertical support for the antenna cables, antenna and power cables and lighting. The vertical access may take the form of steps leading to doors as shown, or alternative means such as a vertical ladder. Base support 11 may contain equipment rooms housing all other equipment necessary for complete operation of the telecommunications facility, eg transmitters, receivers, and support equipment (HVAC and standby generators). Since placing this equipment in a base of an antenna tower is well known in the art, it has not been specifically depicted in the drawings.

Figure 3:
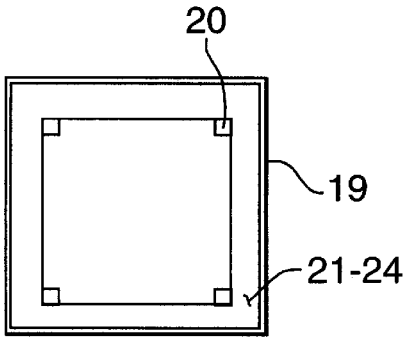
FIG. 3 is a sectional view looking down at the upper portion of the tower along line A—A of FIG. 2.
Figure 4:
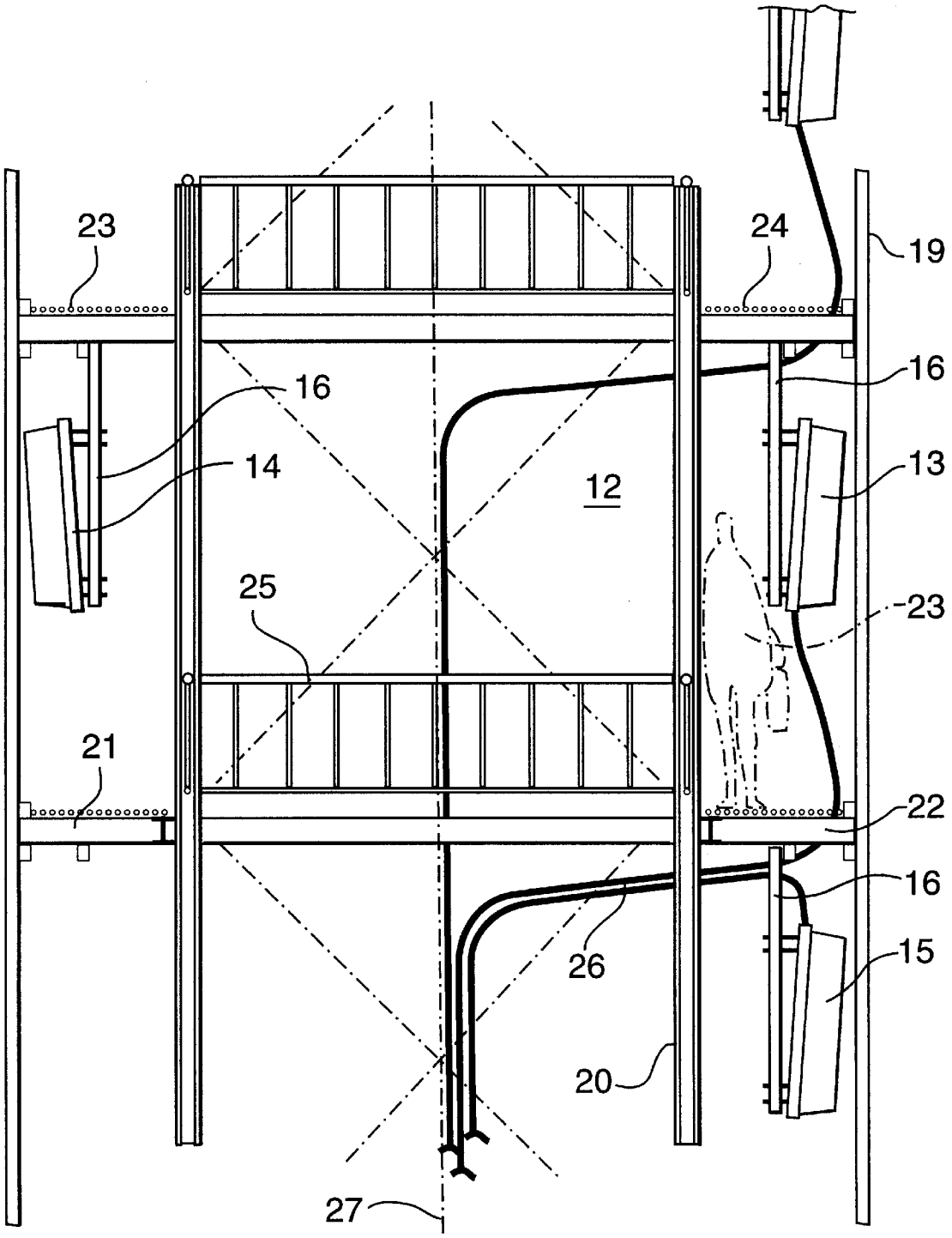
FIG. 4 is a partial detailed cross section of the upper portion of the telecommunication tower illustrating means for adjusting the multiple antennas contained therein.

The essential components of the present invention are more clearly illustrated in FIGS. 2–5. The upper portion of tower 10 comprises a series of antenna-containing modules 12 (dented as 12*a*, 12*b* and 12*c*). They define distinct levels similar to floors where each provider may mount their antennas 13, 14, 15, etc. and complementary devices. The levels or antenna modules 12 consist of a floor 18 and a walkway or annular space 21–24. The walkway encloses the structural tower support 20 and provides structural support to the exterior skin 19 of the antenna tower having a RF transparent exterior covering, preferably being fiberglass or ABS plastic. An annular space or catwalk 21–24 is thus created between the structural tower 20 and the RF transparent exterior skin 19. This floor of the annular walkway also provides structural support for the antenna mounts 16 holding antenna units 13–15 as is best illustrated in FIG. 4. FIG. 3 is a cross section of the upper portion of tower 10 along line A—A.

Most importantly this annular space or walkway in combination with climb ladder 17 provides easy internal access to the antennas mounted within the present tower and a suitable working area for operator 23 to stand while installing, splicing, directing, adjusting or changing the antenna unit. Each antenna unit is thus capable of individual adjustment to meet the needs of its provider, or to make any modifications necessary for good performance.

Figure 5:
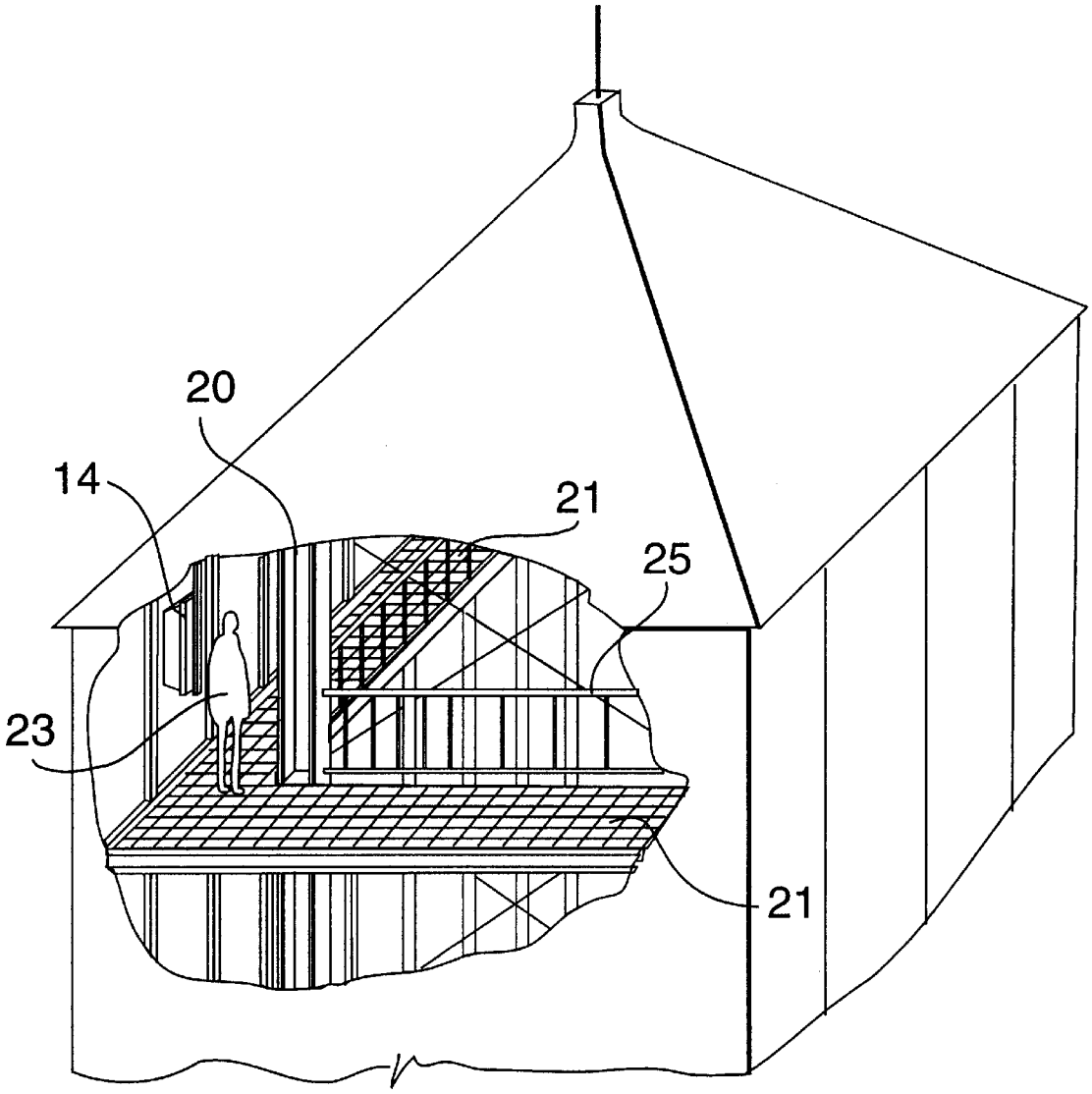
FIG. 5 is an isometric cross section of a corner of the present tower illustrating the ease of the operator moving about internally to make necessary antenna modifications.

For safety reasons the annular walkway or catwalk is provided with a railing 25, as is best illustrated in FIGS. 4 and 5 where the ease of operator 23 moving about the tower to individual antennas 14 is depicted. The annular interior walkway or catwalk 21 is typically about 3.0 to 3.5 feet wide and the height of each antenna module is about 10–15 feet. These dimensions may of course be varied so long as sufficient space is defined for easy movement of the operator to the internally mounted individual antennas as well as defining an appropriate working area for adjustment of the individual antennas.

Antennas are preferably supported from the level above with a cantilever system (pipe supports 16 descending from the annular floor above). This allows the installer or technician to level and plumb the mountings so that the directional antenna can be properly aimed both vertically and horizontally. The antennas may also be set at any location within the entire annular space for total flexibility in setting the antenna to any particular orientation or changing it to meet a new criteria. All this can be done totally within the present multi-user antenna telecommunications tower without any exterior changes. All the antennas are covered at all times and the antennas, cables, splices, hardware, etc. are protected from wind forces and the weather.

Antenna cables 26 are typically gathered as shown in FIG. 4 along cable ladder 27.

The individual modules (both support and antenna-containing units) may be prefabricated and shipped to the tower site for installation. Prefabrication and securing modules is known per se as is described in columns 5 and 6 of U.S. Pat. No. 3,768,016 whose disclosure regarding prefabrication and assembly is incorporated by reference.

Although particular configurations of the present multi-user tower have been shown, various modifications within the spirit of the present invention may be made. The number of antenna modules can be varied as well as the number of antennas in each module. While a climb ladder has been shown for moving from one antenna module to the next, a spiral staircase or mini-elevator can be employed.

Having described the present invention that which is sought to be protected is set forth in the following claims.

I claim:

1. A multi-user antenna telecommunications tower comprising a base support, at least two antenna modules in vertical alignment each containing at least one antenna, an upper tower supporting said antenna modules, a cover of a RF transparent material enclosing said antenna modules, internal passage means between the upper tower support and the RF transparent cover sufficient for an operator to move from one module to another to make desired modifications to the antennas of said antenna modules.

2. The telecommunications tower of claim 1 where each of said antenna modules contains a plurality of antennas.

3. The telecommunications tower of claim 1 which contains a vertical ladder for moving from one module to another.

4. The telecommunications tower of claim 1 wherein the base support is precaste concrete.

5. The telecommunications tower of claim 1 wherein the upper tower support is comprised of steel columns.

6. The telecommunications tower of claim 1 which has an overall pleasing architectural appearance.

7. The telecommunications tower of claim 1 wherein support equipment is placed in the base support.

8. The telecommunication tower of claim 1 wherein the internal annular space has a width of about 3.0 to 3.5 feet so as to easily allow an operator to move about the antenna module and make necessary adjustment to the antenna of said module.

9. The telecommunications tower of claim 1 wherein the upper antenna module has a floor above the lower antenna module, and wherein said antenna on the lower antenna module is supported from above by a pipe support descending from the floor of the antenna module above to facilitate redirection of the antenna.

10. The tower of claim 1 wherein one antenna module is supported from above by a tubular support descending from the floor of the antenna module above it.

11. A multi-user antenna telecommunications tower comprising (1) a base support (2) at least two antenna modules in vertical alignment each containing at least one antenna (3) a tower support for supporting said antenna modules (4) a RF transparent cover enclosing said modules from the external atmosphere (5) an internal annular space between the tower support and the RF transparent cover containing a ladder of sufficient dimensions to allow an operator to move easily about in the annular space from one module to another to make necessary modifications to the antennas of the antenna modules.

12. The tower of claim 11 wherein each antenna module contains a plurality of antennas.

13. The tower of claim 11 wherein the internal annular space is 3 to 3.5 feet in width.

* * * * *